US007861771B2

(12) United States Patent
McCreedy et al.

(10) Patent No.: US 7,861,771 B2
(45) Date of Patent: Jan. 4, 2011

(54) ROD PUMP STUFFING BOX

(75) Inventors: Paul McCreedy, Calgary (CA); Merlin Thiry, Okotoks (CA); Ray Neudorf, Swift Current (CA)

(73) Assignee: Smith International, Inc., Houston, TX (US)

( * ) Notice: Subject to any disclaimer, the term of this patent is extended or adjusted under 35 U.S.C. 154(b) by 426 days.

(21) Appl. No.: 11/761,258

(22) Filed: Jun. 11, 2007

(65) Prior Publication Data

US 2007/0284115 A1 Dec. 13, 2007

Related U.S. Application Data

(60) Provisional application No. 60/813,297, filed on Jun. 12, 2006.

(51) Int. Cl.
*E21B 19/00* (2006.01)

(52) U.S. Cl. ..... 166/84.1; 166/196; 277/511; 277/520

(58) Field of Classification Search ..... 166/84.1, 166/84.4, 106, 86.1, 88.1; 277/502, 522, 277/524, 511, 323, 342, 329; 285/96, 223, 285/235

See application file for complete search history.

(56) References Cited

U.S. PATENT DOCUMENTS 1,884,642 A * 10/1932 Flake ..... 277/505
2,048,320 A * 7/1936 Bennett ..... 384/149
2,564,912 A * 8/1951 McKissick ..... 277/505
6,167,959 B1 * 1/2001 Bassinger et al. ..... 166/84.2

* cited by examiner

*Primary Examiner*—Daniel P Stephenson
*Assistant Examiner*—Kipp C Wallace
(74) *Attorney, Agent, or Firm*—Osha Liang LLP

(57) ABSTRACT

A stuffing box for sealing around a polished rod in a well including a cylindrical connector for receiving the polished rod, a packing member having top and lateral surfaces and wherein the packing member is concentrically disposed around the polished rod, a body concentrically disposed around the packing member and sealing engaging the cylindrical connector, and wherein the body may be selectively moved to expose the top and lateral surface of the packing members is disclosed. A method of repairing, redressing, or replacing packing members of a stuffing box including providing a stuffing box at a wellhead, manipulating the stuffing box such that top and lateral surfaces of the packing members are exposed, removing the packing members, and redressing the stuffing box with new packing members is also disclosed.

18 Claims, 4 Drawing Sheets

REDRESS POSITION

PUMPING POSITION

REDRESS POSITION

ROD PUMP STUFFING BOX

CROSS-REFERENCE TO RELATED APPLICATIONS

This application, pursuant to 35 U.S.C. §119(e), claims priority to U.S. Provisional Application Ser. No. 60/813,297, filed Jun. 12, 2006. That application is incorporated by reference in its entirety.

BACKGROUND OF INVENTION

1. Field of Invention

The present invention pertains to stuffing boxes and scaling assemblies for shafts or rods, particularly well pump rods.

2. Background

Many producing oil wells do not have sufficient well pressure for a natural flow of the well fluid. As a result, some means must be utilized for lifting the well fluid to the earth's surface. Many of the producing oil wells utilize pumping means actuated by a reciprocating rod. The pumping unit itself is normally installed near the bottom of the well bore and is actuated by a string of rods extending downwardly through the well bore from the surface of the ground. The uppermost rod which projects from the wellhead is commonly called the polished rod. A stuffing box is usually secured to the wellhead around the polished rod to prevent leakage of the pumped well fluid from around the polished rod. Packing seals or packing rings of various types are normally disposed within the stuffing box and bear against the outer periphery of the polished rod to provide a sealing engagement there around.

Due to the abrasive sand particles present in crude oil and poor alignment between the wellhead and stuffing box, leakage of crude oil from the stuffing box is common in some applications. It is especially a problem with heavy crude oil wells in which the oil is often produced from semi-consolidated sand formations since loose sand is readily transported to the stuffing box by the viscosity of the crude oil. The reciprocation of the rod with respect to the packing rings wears the inner periphery of the packing rings, thus requiring frequent manual attendance at the stuffing boxes to assure an efficient sealing action around the polished rod.

Oftentimes, the packing rings must be replaced. Existing stuffing boxes do not provide a ready way to remove, replace or adjust old packing seals. In existing stuffing box designs, old packing rings are contained within an immovable cylindrical retainer or body exposing only the top surface of the uppermost packing ring. Thus, to redress the packing box and replace the old packing rings, the old rings must be "dug out" from an opening at the top of the cylinder. Older packing seals can become hardened or brittle over time, making their removal difficult and time consuming.

The embodiments of the present invention described herein provide opportunities for improvement in repair, redress, replacement or adjustment of the packing rings.

SUMMARY OF INVENTION

In one aspect, embodiments disclosed herein relate to a stuffing box for sealing around a polished rod in a well including a cylindrical connector for receiving the polished rod, a packing member having top and lateral surfaces and wherein the packing member is concentrically disposed around the polished rod, a body concentrically disposed around the packing member and sealing engaging the cylindrical connector, and wherein the body may be selectively moved to expose the top and lateral surface of the packing members.

In another aspect, embodiments disclosed herein relate to a method of repairing, redressing, or replacing packing members of a stuffing box including providing a stuffing box at a wellhead, manipulating the stuffing box such that top and lateral surfaces of the packing members are exposed, removing the packing members, and redressing the stuffing box with new packing members.

In another aspect, embodiments disclosed herein relate to a stuffing box for sealing around a polished rod in a well including a cylindrical connector for receiving the polished rod, a housing coaxially disposed around the cylindrical connector, a packing member having top and lateral surfaces and wherein the packing member is concentrically disposed around the polished rod, a body concentrically disposed around the packing member and sealing engaging the cylindrical connector, and wherein the body may be selectively moved downward into an annulus formed between the cylindrical connector and the housing to expose at least a portion of the top and lateral surfaces of the packing members.

These and various other characteristics and advantages will be readily apparent to those skilled in the art upon reading the following detailed description of the preferred embodiments of the invention, and by referring to the accompanying drawings

BRIEF DESCRIPTION OF DRAWINGS

For a more detailed description of the preferred embodiments, reference will now be made to the accompanying drawings, wherein.

DETAILED DESCRIPTION

In one embodiment, embodiments disclosed herein generally relate to improvements in stuffing box configurations. In another embodiment, embodiments disclosed herein also relate to improvements in packing ring configurations and maintenance of stuffing boxes. Embodiments disclosed herein may be configured to be applied to top mounted stuffing boxes, bottom mounted stuffing boxes, integral stuffing boxes and stand-alone stuffing boxes. Stuffing boxes according to embodiments disclosed herein may either be pressurized or non-pressurized.

In accordance with another aspect of the invention, a stuffing box is provided that wherein during repair, redress, replacement or adjustment of the stuffing box packing rings, there is provided ready access to the packing rings. In another aspect of the invention, there is provided a stuffing box wherein during repair and redress, the top and lateral surfaces of the packing rings are exposed.

Figure 1:
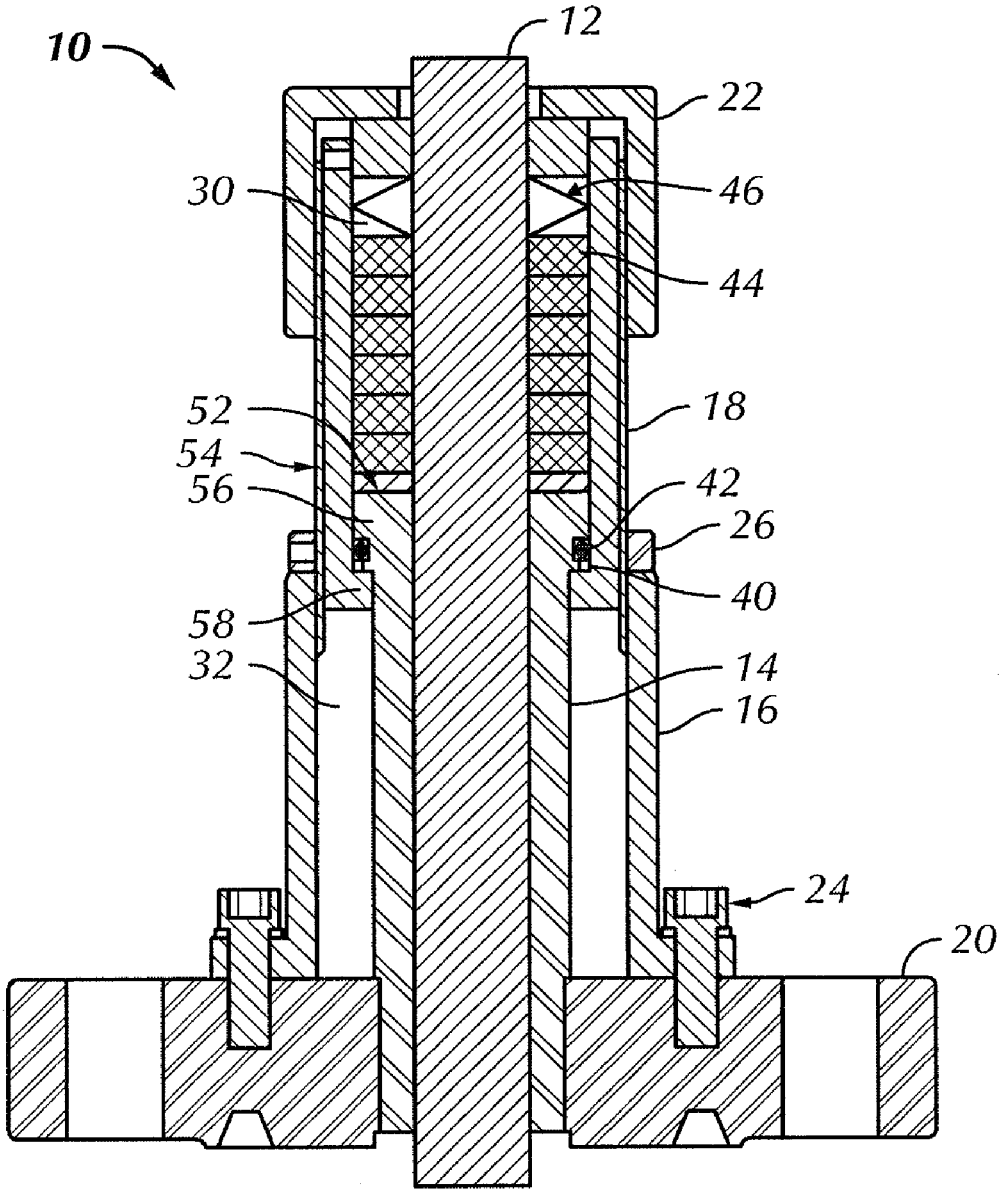
FIG. 1 is a cross section view of a stuffing box in accordance with embodiments disclosed herein.

Referring first to FIG. 1, a cross section view of one embodiment of a stuffing box 10 in accordance with the present disclosure is shown. The stuffing box 10 comprises a substantially cylindrical connector 14 disposed around a portion of a polished rod 12. The cylindrical connector 14 may be, for example, a tubular or pipe or any other cylindrical connection apparatus known in the art. In the embodiment shown, a lower end of the cylindrical connector 14 is threadedly connected to a flange 20. Flange 20 is adapted to be removably connected to a wellhead (not shown). In an alternative embodiment, the cylindrical connector 14 may be attached directly to the wellhead. In this embodiment, the cylindrical connector 14 may be attached to the wellhead by any means known in the art, for example, threaded engagement, a plurality of bolts, etc. In yet another embodiment, an adapter (13 in FIG. 6) may be assembled to a lower end of cylindrical connector 14, wherein an opposite end of the adapter may be attached to the wellhead. (This embodiment is discussed in more detail below with reference to FIG. 6.)

Still referring to FIG. 1, a lower housing 16 is coaxially disposed about cylindrical connector 14. In one embodiment, the lower housing 16 is connected to an upper surface of flange 20. The housing 16 may be secured to flange 20 in any well known manner, such as by a plurality of bolts 24, welding, etc. An annulus 32 is formed between lower housing 16 and connector 14.

In an alternative embodiment (not shown), where a flange is not used, the lower housing 16 may be configured to include an annular shoulder on an inner periphery of the lower end of the housing 16. This inner annular shoulder on housing 16 would engage, by threaded connection or other means known by those skilled in the art, the lower outer periphery of the connector 14 to define a lower end of annulus 32.

Stuffing box 10 further includes a stuffing box body 18. In the embodiment shown, stuffing box body 18 is threadedly connected to lower housing 16 and coaxially disposed about the upper end of cylindrical connector 14. In one embodiment, an upper end 52 of the cylindrical connector 14 is provided with an outwardly extending circumferential flange 56 and a lower end 54 of body 18 is provided with an annular shoulder 58 on the inner periphery, thereby engaging cylindrical connector 14 and body 18 such that selective longitudinal movement of the body 18 and the cylindrical connector 14 may occur. In one embodiment, a sealing member 40 provides a static seal between housing 16 and cylindrical connector 14. In one embodiment, sealing member 40 is a metal-to-metal seal. Additionally, in some embodiments, a seal 42 may disposed around cylindrical connector 14 to provide a seal between the cylindrical connector 14 and the body 18. Seal 42 may include, for example, a tee-seal, a wiper, an elastomer, any seal known in the art, or any combination thereof.

Figure 3:
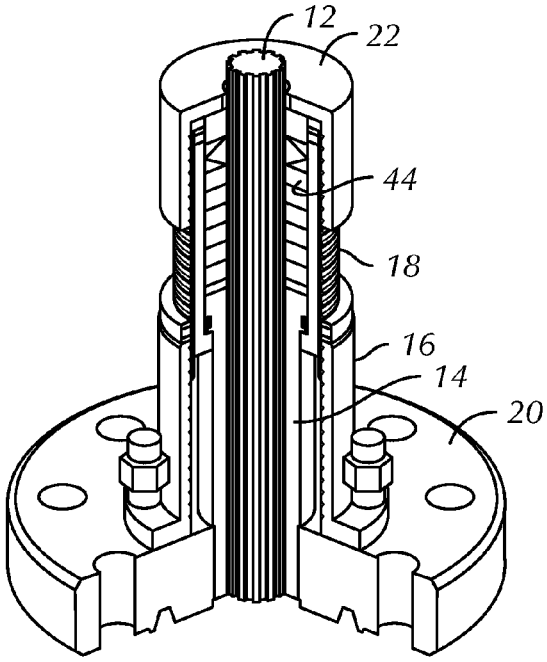
FIG. 3 is a cutaway perspective view of an assembled stuffing box in accordance with embodiments disclosed herein, as when it is in service.

Referring now to both FIGS. 1 and 3, when stuffing box 10 is in service, the lower end 54 of the body 18 is adjacent the upper end 52 of the cylindrical connector 14. A packing member or packing rings 44 are disposed within the annular packing chamber 30 between polished rod 12 and body 18. The packing rings 44 are disposed about the periphery of polished rod 12 and are supported by the upper end 52 of the cylindrical connector 14, or in an alternative embodiment, by packing rings or spacers adjacent the upper end of the cylindrical connector 14. Bellville springs, coil springs, or other spring elements known in the art 46 may also be contained within the packing chamber 30. As shown, a packing nut or packing cap 22 is disposed around polished rod 12 and threadedly attached at the upper of body 18. One of ordinary skill in the art will appreciate that the packing cap 22 may be attached to the upper end of body 18 by any other means in the art. A locking ring 26 is provided to prevent the stuffing box body 18 from being screwed into the lower housing 16 when the packing cap 22 is tightened during assembly and redress.

Figure 2:
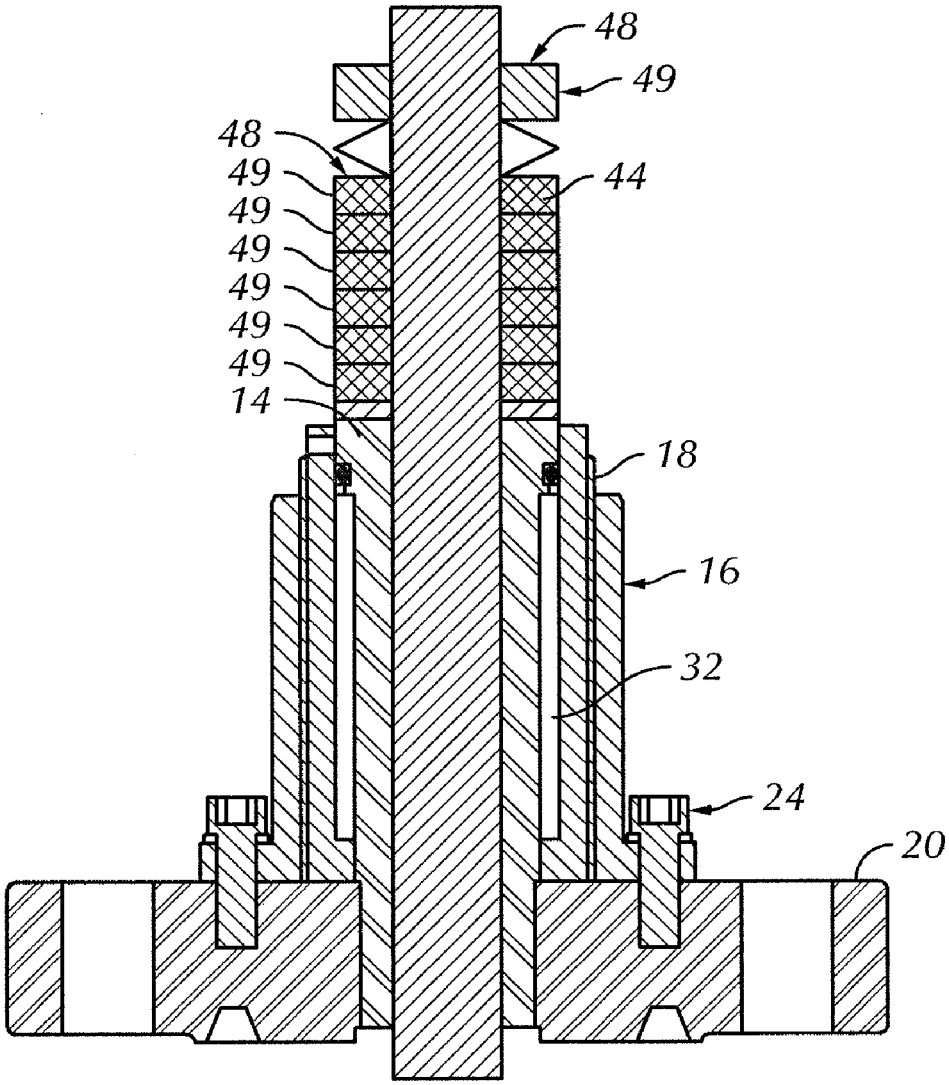
FIG. 2 is a cross section view of a stuffing box in accordance with embodiments disclosed herein, wherein the stuffing box body is moved downward to expose the packing rings for redress.

Referring now to FIG. 2, a cross section view of one embodiment of a stuffing box in accordance with the present disclosure is shown, wherein the stuffing box body 18 is moved longitudinally downwards (i.e., in a direction towards the cylindrical connector 14) to expose the packing members or rings 44 for redress. In one embodiment, the packing rings 44 may be fully exposed once the body 18 is moved downwards. In alternate embodiments, one or more packing rings 44 may be partially exposed once the body 18 is moved downwards. To access the packing rings, body 18 is moved longitudinally downwards into the annulus 32 between the lower housing 16 and the cylindrical connector 14. To move the body longitudinally downwards, the packing cap 22 and lock ring 26 are first removed. In one embodiment, mating threads arc provided along the outer periphery of the body 18 and the inner periphery of the lower housing 16. Thus, the body 18 may moved downwards into annulus 32 by threadedly engaging body 18 with housing 16.

Figure 4:
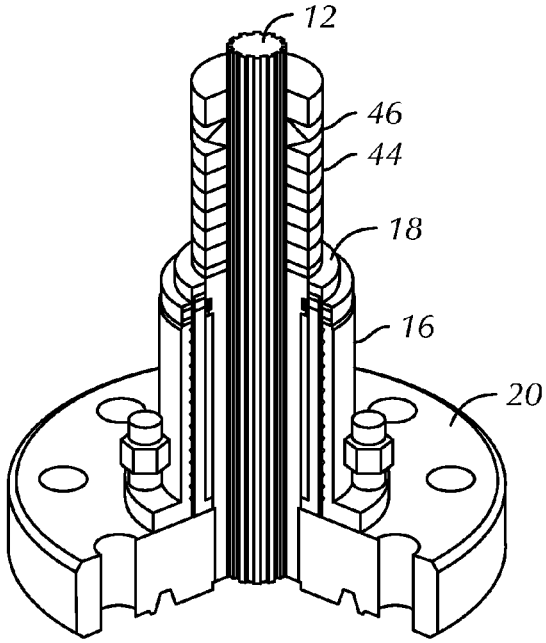
FIG. 4 is a cutaway perspective view of an assembled stuffing box in accordance with embodiments disclosed herein, with a stuffing box cap removed and a body withdrawn.
Figure 5:
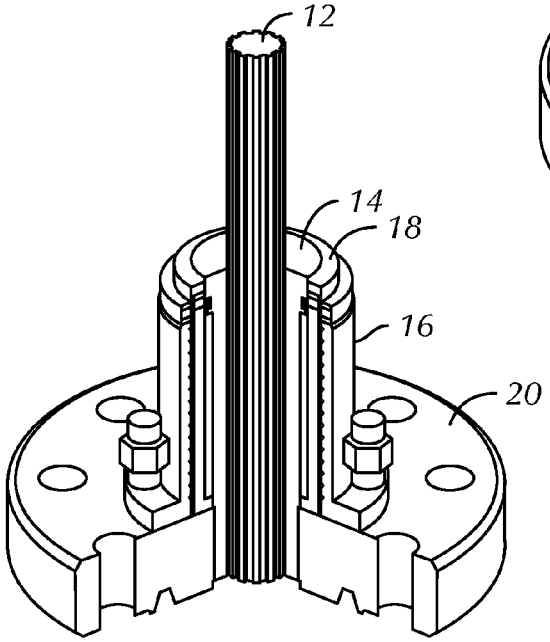
FIG. 5 is a cutaway perspective view of an assembled stuffing box in accordance with embodiments disclosed herein, with a stuffing box cap removed, a body withdrawn and packing rings removed.

As shown in FIGS. 2 and 4, body 18 may be lowered completely into annulus 32 such that a top surface 48 and lateral surface 49 of the packing rings 44 or other elements such as spacers or spring elements 46 may be completely exposed for redress or removal. FIG. 5 shows a cutaway perspective view of a stuffing box in accordance with the present disclosure, with the cap (22 in FIG. 2) removed, body 18 withdrawn, i.e., lowered inside housing 16, and the packing rings (44 in FIG. 2) removed.

Figure 6:
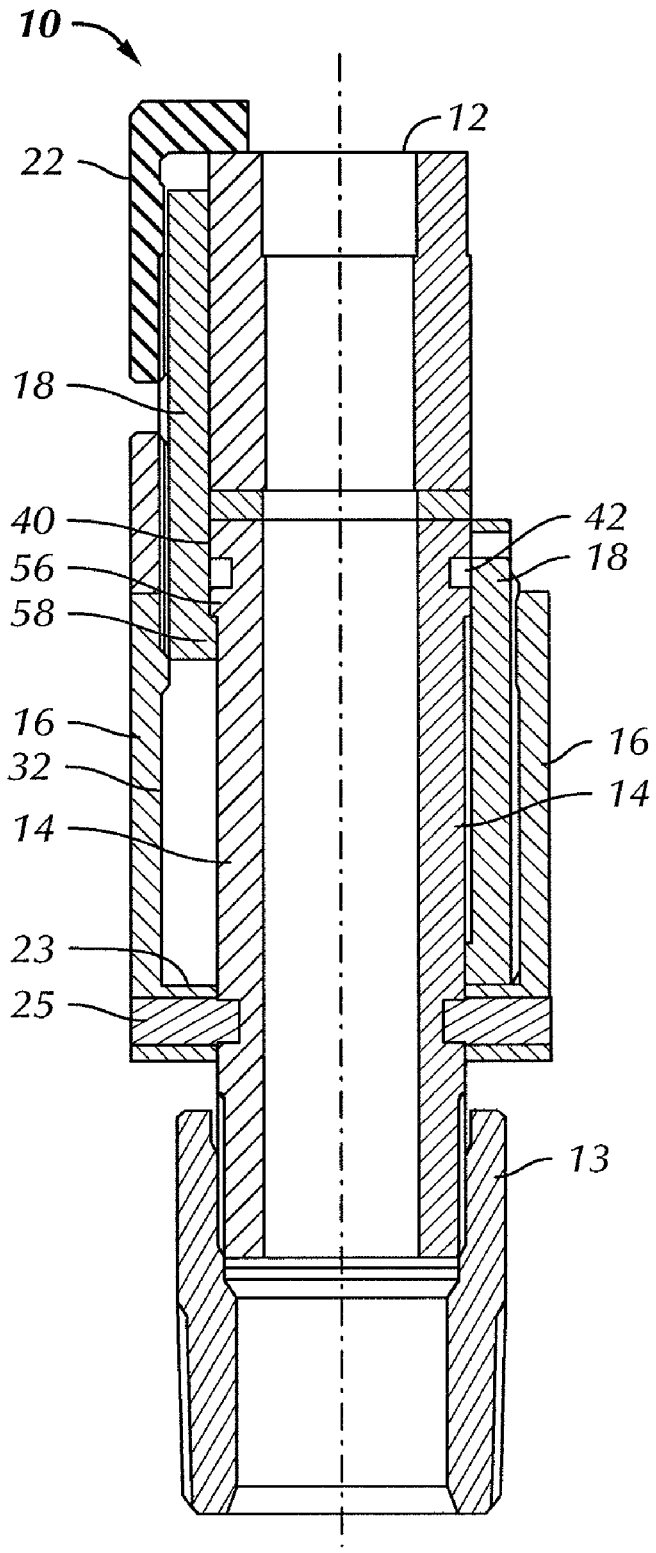
FIG. 6 is a cross section view of a stuffing box in accordance with embodiments disclosed herein.

Referring now to FIG. 6, a cross section view of a stuffing box assembly (left side) and with a stuffing box cap removed and a body withdrawn (right side) in accordance with embodiments disclosed herein is shown. The stuffing box 10 includes a substantially cylindrical connector 14 disposed around a portion of a polished rod 12. The cylindrical connector 14 may be, for example, a tubular or pipe or any other cylindrical connection apparatus known in the art. In the embodiment shown, a lower end of the cylindrical connector 14 is threadedly connected to an adapter 13. In alternate embodiments, the lower end of the cylindrical connector 14 may be connected to adapter 13 by other means known in the art, for example, welds or bolts. Adapter 13 is adapted to be removably connected to a wellhead (not shown). One or ordinary skill in the art will appreciate that the adapter 13 may be connected to the wellhead by any method known in the art, for example, threaded engagement, bolts, etc. The adapter 13 may be a segment of tubular or pipe configured connect cylindrical connector 14 to the wellhead (not shown). In one embodiment, upper and lower ends of adapter 13 may include a box connection. In another embodiment, the upper end of adapter 13 may include a box connection, while the lower end of adapter 13 may include a pin connection. One of ordinary skill in the art will appreciate that the adapter 13 may be configured in any know configuration such that cylindrical connector 14 is connected to the wellhead (not shown).

Still referring to FIG. 6, a lower housing 16 is coaxially disposed about cylindrical connector 14. An annulus 32 is formed between lower housing 16 and connector 14. In the embodiment shown, the lower housing 16 is configured to include an annular shoulder 23 on an inner periphery of the lower end of the housing 16. This inner annular shoulder 23 on housing 16 engages the lower outer periphery of the connector 14 to define a lower end of annulus 32. Annular shoulder 23 of the housing 16 may engage the cylindrical connection 14 by any means known in the art, for example by threaded engagement or bolts 25.

Stuffing box 10 further includes a stuffing box body 18. In the embodiment shown, stuffing box body 18 is threadedly connected to lower housing 16 and coaxially disposed about the upper end of cylindrical connector 14. In one embodiment, an upper end of the cylindrical connector 14 is provided with an outwardly extending circumferential flange 56 and a lower end of body 18 is provided with an annular shoulder 58 on the inner periphery, thereby engaging cylindrical connector 14 and body 18 such that selective longitudinal movement of the body 18 and the cylindrical connector 14 may occur. In one embodiment, a sealing member 40 provides a static seal between housing 16 and cylindrical connector 14. In one embodiment, sealing member 40 is a metal-to-metal seal. Additionally, in some embodiments, a seal 42 may disposed around cylindrical connector 14 to provide a seal between the cylindrical connector 14 and the body 18. Seal 42 may include, for example, a tee-seal, a wiper, an elastomer, any seal known in the art, or any combination thereof.

Embodiments disclosed herein further relate to a method of repairing, redressing, or replacing packing rings of a stuffing box. In one embodiment, the method of repairing, redressing, or replacing packing rings of a stuffing box includes the steps of: providing a stuffing box at a wellhead; manipulating the stuffing box such that top and lateral surfaces of the packing members are completely exposed; removing the packing members; and redressing the stuffing box with new packing members.

In one embodiment, a stuffing box having a tubular connector for receiving a polished rod, a packing member having top and lateral surfaces, wherein the packing member is concentrically disposed around the polished rod, and a body concentrically disposed around the packing member and configured to sealing engage the tubular connector. Additionally, a housing may be coaxially disposed around the tubular connector, thereby forming an annulus between the housing and the tubular connector. In this embodiment, manipulating the stuffing box may include moving the body longitudinally towards the tubular connection. In one embodiment, mating threads are provided along the outer periphery of the body 18 and the inner periphery of the lower housing 16. Thus, the body 18 may moved downwards into annulus 32 by threadedly engaging body 18 with housing 16. Once the body has been at least partially moved into the annulus formed between the housing and the tubular connector, thereby exposing the top and lateral surfaces of the packing members, the packing element may be removed from around the polished rod.

New packing members may then be installed around the polished rod, also referred to as redressing the stuffing box. Spring elements and/or spacers may also be installed around the polished rod. The body of the stuffing box may then be moved longitudinally upwards into a position wherein the body is concentrically disposed around the new packing members. A locking ring may be installed around the body and longitudinally above the tubular connection once the body has been moved into the position where the body is concentrically disposed around the new packing members. The locking ring is provided to prevent the stuffing box body from being screwed into the lower housing when a packing cap is tightened during redress.

The invention may be varied freely within the scope of the appended claims.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

While various preferred embodiments of the invention have been shown and described, modifications thereof can be made by one skilled in the art without departing from the spirit and teachings of the invention. The embodiments herein are exemplary only, and are not limiting. Many variations and modifications of the invention and apparatus disclosed herein are possible and within the scope of the invention. Accordingly, the scope of protection is not limited by the description set out above, but is only limited by the claims which follow, that scope including all equivalents of the subject matter of the claims.

What is claimed:

1. A stuffing box for sealing around a polished rod in a well, comprising:

a cylindrical connector for receiving the polished rod;

a packing member having top and lateral surfaces and wherein said packing member is concentrically disposed around the polished rod; and a body concentrically disposed around said packing member and sealingly engaging said cylindrical connector, wherein said body is selectively moved longitudinally downward to expose said top and lateral surfaces of said packing members, and wherein the cylindrical connector comprises an outwardly extending circumferential flange disposed at an upper end of the cylindrical connector and the body comprises an annular shoulder on an inner periphery configured to engage the cylindrical connector.

2. The stuffing box of claim 1, further comprising a housing coaxially disposed around the cylindrical connector, wherein an annulus is formed between the housing and the cylindrical connector.

3. The stuffing box of claim 2, wherein the housing comprises an annular shoulder on an inner periphery proximate a lower end of the housing configured to engage a mating connection on a lower outer periphery of the cylindrical connector.

4. The stuffing box of claim 1, wherein sealing engagement between the body and the cylindrical connector is provided by a metal-to-metal seal.

5. The stuffing box of claim 4, further comprising a tee-seal.

6. The stuffing box of claim 1, further comprising at least one spring disposed longitudinally adjacent the packing member.

7. The stuffing box of claim 2, further comprising a locking device configured to prevent the body from lowering into the housing during assembly and redress.

8. The stuffing box of claim 1, further comprising an adapter configured to attach the cylindrical connector to a wellhead.

9. A method of repairing, redressing, or replacing packing members of a stuffing box comprising:

providing a stuffing box at a wellhead, the stuffing box comprising:

a cylindrical connector for receiving a polished rod; and a body concentrically disposed around the packing member and sealingly engaging the cylindrical connector, wherein the cylindrical connector comprises an outwardly extending circumferential flange disposed at an upper end of the cylindrical connector, and the body comprises an annular shoulder on an inner periphery configured to engage the cylindrical connector;

manipulating the stuffing box such that top and lateral surfaces of the packing members are exposed, wherein the manipulating comprises moving the body longitudinally downward towards the cylindrical connector;

removing the packing members; and redressing the stuffing box with new packing members.

10. The method of claim 9, wherein the providing a stuffing box comprises:

providing the cylindrical connector for receiving a polished rod;

providing the packing member having top and lateral surfaces, wherein the packing member is concentrically disposed around the polished rod; and disposing the body concentrically around the packing member and configured to sealingly engage the cylindrical connector.

11. The method of claim 10, further comprising providing a housing coaxially disposed around the cylindrical connector.

12. The method of claim 9, further comprising moving the body longitudinally upwards into a position wherein the body is concentrically disposed around the new packing members.

13. The method of claim 12, further comprising assembling a cap around the polished rod and engaging the cap with an upper end of the body.

14. The method of claim 10, further comprising providing a locking device around the body to prevent the body from lowering into the housing during assembly and redress.

15. A stuffing box for sealing around a polished rod in a well, comprising:

a cylindrical connector for receiving the polished rod;

a housing coaxially disposed around the cylindrical connector;

a packing member having top and lateral surfaces and wherein said packing member is concentrically disposed around the polished rod;

a body concentrically disposed around said packing member and sealingly engaging said cylindrical connector, and wherein said body is selectively moved downward into an annulus formed between the cylindrical connector and the housing to expose at least a portion of the top and lateral surfaces of said packing members.

16. The stuffing box of claim 15, wherein a lower end of the housing comprises an annular shoulder on an inner periphery configured to engage a lower outer periphery of the cylindrical connector.

17. The stuffing box of claim 15, further comprising an adapter configured to attach the cylindrical connector to a wellhead.

18. A stuffing box for sealing around a polished rod in a well, comprising:

a cylindrical connector for receiving the polished rod;

a packing member having top and lateral surfaces and wherein said packing member is concentrically disposed around the polished rod;

a body concentrically disposed around said packing member and sealingly engaging said cylindrical connector, wherein said body is selectively moved longitudinally downward to expose said top and lateral surfaces of said packing members; and a housing coaxially disposed around the cylindrical connector, wherein an annulus is formed between the housing and the cylindrical connector, wherein the housing comprises an annular shoulder on an inner periphery proximate a lower end of the housing configured to engage a mating connection on a lower outer periphery of the cylindrical connector.

* * * * *